United States Patent [19]

Southam

[11] 4,224,054

[45] Sep. 23, 1980

[54] PROCESS FOR THE PRODUCTION OF ALUMINIUM

[75] Inventor: Frederick W. Southam, Kingston, Canada

[73] Assignee: Alcan Research and Development Limited, Montreal, Canada

[21] Appl. No.: 962,622

[22] Filed: Nov. 21, 1978

[30] Foreign Application Priority Data

Nov. 28, 1977 [GB] United Kingdom ..... 49445/77

[51] Int. Cl.[2] ..... C22D 7/02

[52] U.S. Cl. ..... 75/10 R; 75/68 A

[58] Field of Search ..... 75/68 R, 10 R, 46, 68 A

[56] References Cited

U.S. PATENT DOCUMENTS

| | | | |
|---|---|---|---|
| 3,734,716 | 5/1973 | Seglin et al. | 75/46 |
| 4,099,959 | 7/1978 | Dewing et al. | 75/68 A |

*Primary Examiner*—M. J. Andrews

*Attorney, Agent, or Firm*—Cooper, Dunham, Clark, Griffin & Moran

[57] ABSTRACT

A process for the production of aluminium in two steps:

$$2Al_2O_3+9C=Al_4C_3+6CO \quad \text{(ii)}$$

and $$Al_4C_3+Al_2O_3=6Al+3CO \quad \text{(iii)}$$

Reaction (ii) takes place in a materials addition chamber and reaction (iii) in a high temperature chamber. Slag is circulated between the chambers via conduits and is promoted by gas supplied from an external supply. Chamber heating may be by electrical resistance between chamber electrodes and the gas may be introduced via one or more hollow electrodes.

6 Claims, 4 Drawing Figures

PROCESS FOR THE PRODUCTION OF ALUMINIUM

The present invention relates to the production of aluminium by the direct reduction of alumina by carbon.

The direct carbothermic reduction of alumina has been described in the U.S. Pat. Nos. 2,829,961 and 2,974,032, and furthermore the scientific principles involved in the chemistry and thermodynamics of the process are very well understood.

It has long been recognised (U.S. Pat. No. 2,829,961) that the overall reaction involved in the carbothermic reduction of alumina $$Al_2O_3+3C=2Al+3CO \quad \text{(i)}$$

takes place, or can be made to take place, in two steps:

$$2Al_2O_3+9C=Al_4C_3+6CO \quad \text{(ii)}$$

and $$Al_4C_3+Al_2O_3=6Al+3CO \quad \text{(iii)}$$

Both reactions are highly endothermic but the reaction (ii) which leads to the formation of $Al_4C_3$ can be seen, from the available thermodynamic data, to proceed at an appreciably lower temperature than the reaction (iii), which leads to conversion of aluminium carbide to aluminium. Due to the lower temperature and lower thermodynamic activity of aluminium at which reaction (ii) may take place, the concentration of fume (in the form of gaseous Al and gaseous $Al_2O$) carried off by the gas from reaction (ii) when carried out at a temperature appropriate to that reaction is much lower than that carried in the gas at a temperature appropriate to reaction (iii); furthermore, the volume of CO from reaction (iii) is only half that from reaction (ii).

Existing data suggests that the energy required for each of the two stages is of the same order of magnitude.

We have already described in U.S. Pat. No. 4,099,959 a process for the production of aluminium metal by the carbothermic reduction of alumina which relies on establishing a circulating stream of molten alumina slag, containing combined carbon, in the form of aluminium carbide or oxycarbide; circulating the stream of molten alumina slag through a low temperature zone maintained at least in part at a temperature at or above that required for reaction of alumina with carbon to form aluminium carbide (reaction (ii)) but below that required for reaction of aluminium carbide with alumina to release Al metal (reaction iii)) and introducing carbon in this zone; forwarding the stream of molten alumina now enriched in $Al_4C_3$ as a result of reaction (ii), to a high temperature zone (maintained at least in part at a temperature at or above a temperature required for reaction (iii)); and collecting and removing aluminium metal liberated at said high temperature zone as a result of reaction (iii), the molten alumina slag from the high temperature zone then being forwarded to the same or another low temperature zone. The introduction of alumina to make up the alumina consumed in the process is preferably effected at the high temperature zone.

The product aluminium and at least a major part of the gas evolved in reaction (iii) are preferably separated from the molten slag by gravitational action by allowing them to rise through the molten slag in the high temperature zone so that the product aluminium collects as a supernatant layer on the slag and the evolved gas blows off to a gas exit passage leading to apparatus for fume removal.

The process as described in U.S. Pat. No. 4,099,959 is primarily envisaged as depending upon the introduction of the necessary energy into the system by electrical resistance heating. Current was passed through the stream of molten slag in transit from the low temperature zone and during at least part of its path through the high temperature zone.

The requirements for introduction of heat energy into the system are three-fold (a) to support reaction (ii), (b) to support reaction (iii) and (c) to make up heat losses. The heat requirement (a) may be provided by the sensible heat of the slag as it enters the low temperature zone. If the heat losses in the part of the system between the point of aluminium and gas separation and the low temperature zone can be sufficiently restricted it may be unnecessary to introduce any additional energy into the slag stream during flow through this part of the system since it already has sufficient sensible heat.

One form of apparatus for carrying out the process included one or more materials addition chambers where reaction of alumina with carbon to form aluminium carbide (reaction (ii)) occurred at a relatively low temperature and one or more high temperature chambers for removal of product aluminium and gas evolved in reaction of aluminium carbide with alumina to release Al metal (reaction (iii)), each materials addition chamber being connected to the succeeding high temperature chamber by a forward connecting conduit which led into the high temperature chamber through an upwardly directed portion. Each high temperature chamber led into a succeeding materials addition chamber by a return conduit. Heat input to the system was achieved be electrical resistance heating of the slag and the system was arranged so that this took place primarily in the forward connecting conduit (or each such conduit when the apparatus included a series of materials addition chambers and high temperature chambers). The arrangement ensured that reaction (iii) took place to a substantial extent in the upwardly directed terminal portion of the conduit with the result that the gas released in this part of the system acted as a gas lift pump to propel the stream of slag around the system.

Where the system included only a single materials addition chamber and high temperature chamber (and consequently the forward conduit and return conduit formed parallel electrical connections between the two chambers) it was necessary to dimension these conduits somewhat differently from the conduits in a multi-chamber system where the connecting conduits are connected electrically in series.

It will be apparent with a system arranged so that major evolution of heat occurs in the forward conduit or conduits that the rate of slag circulation will also be dependent upon the rate of gas evolution in the forward conduit or conduits. Slag circulation rate can only be increased or decreased by increase or decrease of the reaction (iii) gas evolution rate. If other factors are maintained constant, as would be the aim in operation, control of circulation rate could only be achieved by increase or decrease of applied voltage to increase or decrease current flow.

However, when power input is changed, both circulation rate and metal production rate change, but not in the same proportion with the result that the composition of the slag in the system slowly shifts to a new value. This may lead to problems, such as instability of the frozen alumina lining in the conduits. In addition slag flow instabilities may occur because of interaction between the gas evolution and the electrical properties of the system. This could lead to oscillations in the heating current.

It is an object of this invention to provide an improvement in the process which allows the slag circulation rate to be controlled independently of the input of heat energy into the system. This is achieved in accordance with the present invention by employing a pressurised external gas supply to promote the rate of slag circulation through the system. Control of the external gas supply rate allows the slag circulation rate to be regulated. Most preferably the external gas supply is employed to provide at least the major part of the energy for propulsion of the slag stream. The external gas supply may be introduced via one or more conduits leading into either the forward conduit from the materials addition chamber to the high temperature chamber or into the return conduit leading to the succeeding materials addition chamber. However, partial use of reaction-generated gas for slag propulsion is not preferred since it does not make use of the full potential of the invention for simplifying the apparatus employed.

A more preferred system is arranged in such a way that no significant generation of gas occurs in either forward or reverse conduits. In this embodiment of the invention both the materials addition chamber or chambers and the high temperature chamber or chambers are provided with means for generating heat energy within the chamber and means are provided for directing a stream of external gas into the forward and/or return conduits to promote the circulation of the slag stream.

Heat is preferably generated both in each materials addition chamber and in each high temperature chamber by electrical resistance heating. This involves providing at least two spaced electrodes in such chambers with preferably some restriction in the current path between them to provide a local electrical resistance. It is possible to conceive other means for independently heating the molten slag in these chambers. Thus in place of electrical resistance heating the contents of a chamber might be heated by the use of a plasma gun arranged in the respective chamber. Where electrical resistance heating is employed the propelling gas is most conveniently introduced through a conduit formed in one of the resistance-heating electrodes and positioned so that the gas issuing from it is directed into the lower end of an upwardly directed conduit leading out of the chamber in which the electrode is located. Since the contents of each materials addition chamber are lower in temperature and essentially in equilibrium with carbon they are less aggressive on a carbon electrode and therefore the propulsion gas is most conveniently introduced through an electrode that provides current to heat the slag in a materials addition chamber, preferably in each materials addition chamber.

With this arrangement it is possible to control the rate of circulation of the slag stream entirely independently of the heat input into the respective chambers by variation of the rate of supply of the propelling gas (which will preferably be carbon monoxide recirculated from one of the chambers). The composition of the contents of each materials addition chamber and each high temperature chamber may also be controlled at desired values and hence it becomes possible to establish and maintain optimum control of the process.

While it is possible to contemplate a system of this type in which heat generation is effected only in each high temperature chamber, the employment of an independent heating system in each materials addition chamber gives greater operational flexibility to the system.

The accompanying drawings illustrate diagrammatically apparatus for putting the present invention into practice. In the drawings.

Figure 1:
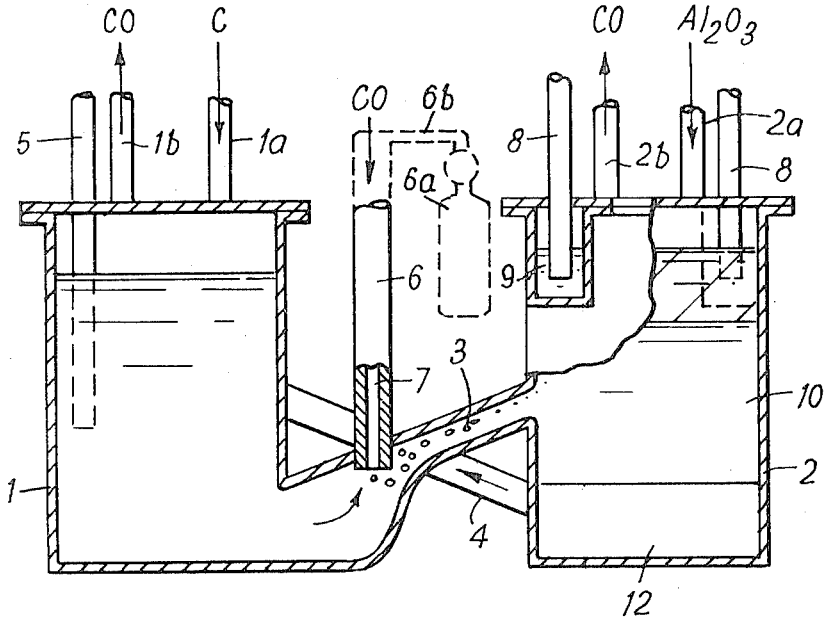
FIG. 1 is a side view of one form of apparatus.
Figure 2:
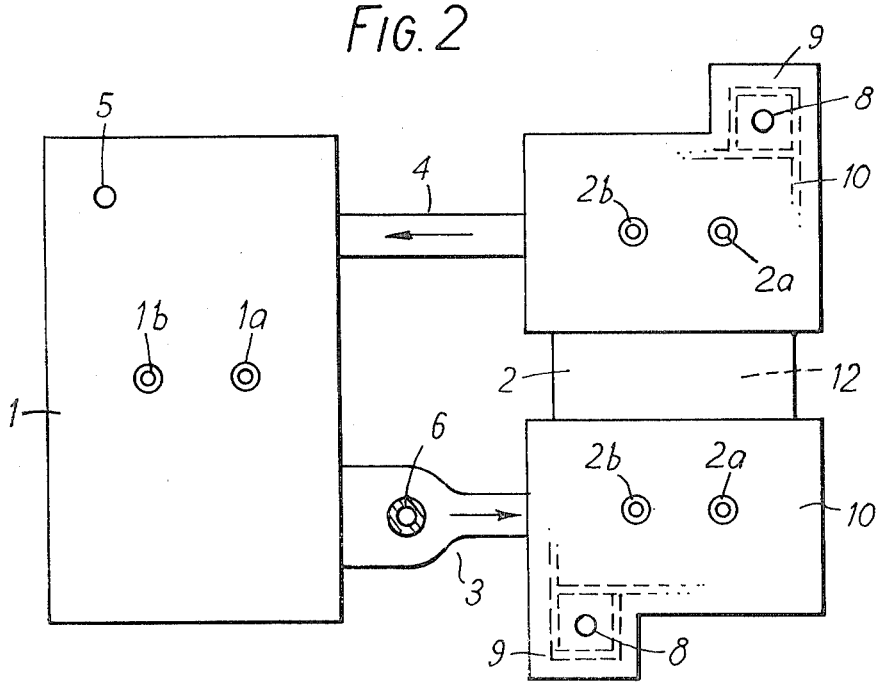
FIG. 2 is a plan view of the apparatus of FIG. 1.
Figure 3:
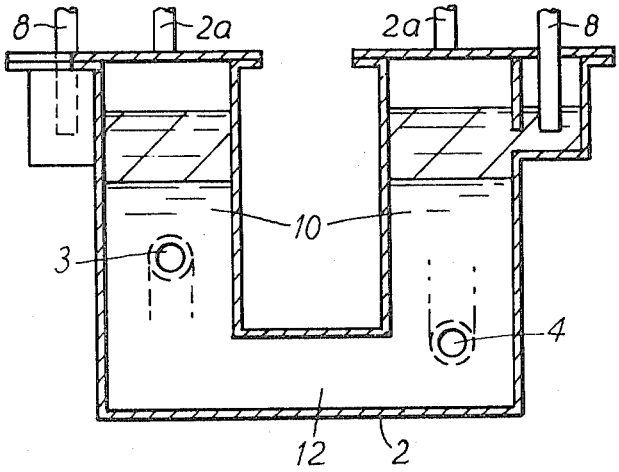
Figure 4:
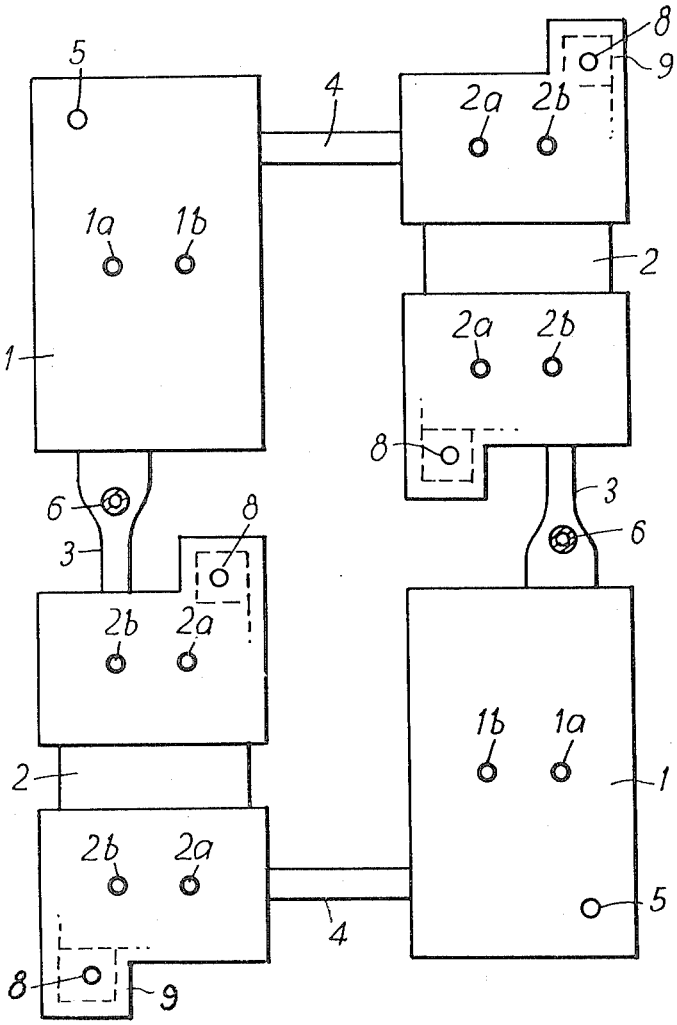

FIG. 3 is an end view of the high temperature chamber of the apparatus of FIG. 1, and FIG. 4 is a plan view of a modified form of apparatus, In the apparatus of FIGS. 1 and 2 the molten alumina slag is circulated through a system comprising a materials addition chamber 1 and a high temperature chamber 2, connected to each other by a forward conduit 3 and a return conduit 4. Both conduits 3 and 4 lead upwardly in the direction of slag flow.

Chamber 1 is provided with electrodes 5 and 6 and with ducts 1*a* and 1*b* for the introduction of carbon feed and for leading away the evolved carbon monoxide. The electrode 6 is formed of hollow graphite rod which forms an entry duct for a stream of propulsion gas through the passage 7 formed thereby. The propulsion gas is derived from an external supply source 6*a* via a conduit 6*b* coupled to the electrode 6. The electrode 6 is introduced into the chamber 1 through a seal leg and gland. This allows the tubular electrode to be lowered to compensate for the slight consumption of the electrode. The lower end of the electrode 6 is located in such a way that the stream of propulsion gas ascends the forward conduit 3 to promote slag circulation from the chamber 1 to the high temperature chamber 2.

The chamber 2 is provided with a pair of electrodes 8, which are located in relatively cool side wells 9 in which they are in contact with a layer of product Al, which is saturated with $Al_4C_3$, so that the $Al/Al_4C_3$ layer forms liquid electrodes in contact with the slag. The chamber 2 therefore has two separate product collection zones 10 in which electrodes are respectively located for passage of current through the body of the molten slag in the chamber 2. Gas outlet ducts 2*b* are provided above the molten slag in both collection zones 10. Make-up alumina feed is supplied at some points in the system, preferably at the collection zones 10 via feed ducts 2*a*. In a preferred procedure metal is tapped alternately from each collection zone with alumina being fed to the collection zone next to be tapped so as to lower the carbon content of the metal.

In operation molten slag enters the upper part of the chamber 1 in the region of the electrode 5 and immediately encounters and reacts with fresh carbon feed, so that it is immediately chilled by loss of heat through reaction with carbon in reaction (ii). The major evolution of carbon monoxide in chamber 1 is therefore at or near the surface of the slag, although gas evolution will continue until carbon feed particles are consumed. The heat requirements for maintenance of selected temperature conditions in chamber 1 are supplied by passing current between electrodes 5 and 6.

The chamber 2 is shaped so that there is a restricted passage 12 between the collection zones 10 so that the major release of heat energy is at the bottom of the chamber. The evolution of gas in this region promotes vigorous circulation through all the parts of the chamber within which the reaction (iii) takes place. As shown in the drawings the entry from the forward duct and the entry to the return duct are preferably on opposite sides of the passage 12.

FIG. 4 shows a modified form of apparatus employing two materials addition chambers and two high temperature chambers. The same reference numerals are applied to the same parts as in FIGS. 1 and 2. Since the electrodes in each chamber are arranged in independent circuits there is no passage of current in either forward or return conduits.

As compared with the systems described in U.S. Pat. No. 4,099,959 the systems described with reference to the drawings have the advantage that the heat generated in the materials addition chamber and in the high temperature chamber can be separately controlled and adjusted to the best operating conditions for the respective reactions. Furthermore the rate of circulation of the slag through the system can be controlled entirely independently of the heat supply by increasing or decreasing the rate of supply of propulsion gas via conduit 7. It will be noted that in contrast with the systems described in U.S. Pat. No. 4,099,959 the high temperature reaction (iii) no longer takes place to any substantial extent in the forward conduit in the illustrated apparatus. However, if desired, heat can be generated in the forward conduit (or each forward conduit) by connecting each electrode 6 and the adjacent electrode 8 in the succeeding high temperature chamber across a separate power source. This technique is described in co-pending patent application Ser. No. 962,630, filed Nov. 21, 1978, by Ernest William Dewing, and assigned to the same assignee as the present application.

It is a further advantage of the use of an outside source of gas to secure circulation of the slag in the system that in the event of a failure of the source of heat, circulation can be maintained and the sensible heat of the slag contained in the chambers will delay freezing of the conduits for an appreciable time, provided that the addition of feed materials is avoided.

Both to provide greater operational safety in this respect and to provide greater operational flexibility it is preferred to arrange that there is a gas flow inlet at or near the lower end of the or each forward conduit 3 and of the or each return conduit 4 in the systems illustrated in the drawings.

The externally supplied gas for the regulation of slag circulation in the process of the present invention is most preferably carbon monoxide. Hydrogen and argon are examples of other suitable gases for the purpose.

I claim:

1. A process for the production of aluminium metal by the carbothermic reduction of alumina which relies on establishing a circulating stream of molten alumina slag, containing combined carbon, in the form of at least one of aluminium carbide or oxycarbide; circulating the stream of molten alumina slag through a low temperature zone maintained at least in part at a temperature at or above that required for reaction of alumina with carbon to form aluminium carbide (reaction (ii)) but below that required for reaction of aluminium carbide with alumina to release Al metal (reaction (iii)) and introducing carbon in this zone; forwarding the stream of molten alumina, now enriched in $Al_4C_3$ as a result of reaction (ii), to a high temperature zone (maintained at least in part at a temperature at or above a temperature required for reaction (iii)); and collecting and removing aluminium metal liberated at said high temperature zone as a result of reaction (iii), the molten alumina slag from the high temperature zone then being forwarded to the same or another low temperature zone whilst introducing alumina into said circulating slag stream at at least one location, wherein circulation of the slag is promoted by the provision of gas from an external pressurised supply at a controllably variable rate.

2. A process as claimed in claim 1 wherein the gas from the external supply provides at least the major part of the energy for propulsion of the slag stream.

3. A process as claimed in claim 2 wherein reaction (ii) takes place in one or more materials addition chambers and reaction (iii) takes place in one or more high temperature chambers, the slag circulating between the chambers via forward and return conduits, the heat for maintaining reactions (ii) and (iii) being generated in the high temperature chambers and/or the materials addition chambers.

4. A process as claimed in claim 3 wherein the heating in the chamber is effected by electrical resistance heating within the chamber, a pair of electrodes being provided in the or each heated chamber.

5. A process as claimed in claim 4 wherein the or at least one of the heated chambers has one of its said electrodes hollow and situated near the lower end of an upwardly directed conduit leading out of the chamber and the said gas from the external supply is fed to the system via the hollow electrode or electrodes.

6. A process as claimed in claim 5 wherein the hollow electrodes are situated in the or each materials addition chamber.

* * * * *